US007204584B2

(12) United States Patent
Lean et al.

(10) Patent No.: US 7,204,584 B2
(45) Date of Patent: Apr. 17, 2007

(54) CONDUCTIVE BI-LAYER INTERMEDIATE TRANSFER BELT FOR ZERO IMAGE BLOOMING IN FIELD ASSISTED INK JET PRINTING

(75) Inventors: Meng H. Lean, Santa Clara, CA (US); John J. Ricciardelli, Poughkeepsie, NY (US); Fred R. Stolfi, Shrub Oak, NY (US); Osman T. Polatkan, North Haledon, NJ (US); Michael J. Savino, Tappan, NY (US)

(73) Assignee: Xerox Corporation, Stamford, CT (US)

( * ) Notice: Subject to any disclaimer, the term of this patent is extended or adjusted under 35 U.S.C. 154(b) by 307 days.

(21) Appl. No.: 10/954,207

(22) Filed: Oct. 1, 2004

(65) Prior Publication Data

US 2006/0071977 A1 Apr. 6, 2006

(51) Int. Cl.
*B41J 2/06* (2006.01)

(52) U.S. Cl. ..... 347/55

(58) Field of Classification Search ..... 347/20, 347/54, 55, 103, 111, 120, 123, 141, 151, 347/154, 159, 177, 128, 131, 125, 158; 399/271, 399/290, 292

See application file for complete search history.

(56) References Cited

U.S. PATENT DOCUMENTS

| | | | | |
|---|---|---|---|---|
| 6,079,814 | A | 6/2000 | Lean et al. | 347/55 |
| 6,367,909 | B1 | 4/2002 | Lean | 347/37 |
| 6,508,540 | B1 | 1/2003 | Lean et al. | 347/55 |
| 6,513,909 | B1 * | 2/2003 | Elrod et al. | 347/55 |

* cited by examiner

*Primary Examiner*—Juanita D. Stephens
(74) *Attorney, Agent, or Firm*—Oliff & Berridge, PLC

(57) ABSTRACT

A transfer belt apparatus, system and method are provided to prevent image blooming. For example, an ink jet printing apparatus may include a grounded print head, a counter-electrode opposite the ground print head, and a bi-layer transfer belt provided between a print head and a counter-electrode and at least partially supported by two or more transfer bias rollers. A method may include applying a voltage between a print head and a counter-electrode to accelerate ink drops coming out of the print head toward a transfer belt, and evacuating charge accumulated on the transfer belt with a time constant smaller than a drop ejection frequency of the print head.

20 Claims, 4 Drawing Sheets

CONDUCTIVE BI-LAYER INTERMEDIATE TRANSFER BELT FOR ZERO IMAGE BLOOMING IN FIELD ASSISTED INK JET PRINTING

BACKGROUND OF THE INVENTION

1. Field of Invention

This invention relates to image printing systems, and more particularly to eliminating blooming in ink jet printing.

2. Description of Related Art

The following patents are hereby incorporated by reference in their entirety: U.S. Pat. No. 6,513,909 to Elrod for its teaching of a method of forming and moving ink drops across a gap between a print head and a print medium in a marking device that includes generating an electric field, forming the ink drops adjacent to the print head and controlling the electric field; and U.S. Pat. No. 6,079,814 to Lean for its teaching of improved ink droplet placement on a recording medium.

A conventional method of forming and moving ink drops across a gap between a print head and a print medium, or an intermediate print medium in a marking device, includes generating an electric field, forming the ink drops adjacent to the print head, and controlling the electric field. The electric field is generated to extend across the entire gap, and the ink drops are formed in an area adjacent to the print head. Accordingly, the electric field is controlled such that an electrical attraction force exerted on the formed ink drops by the electric field is the largest force acting on the ink drops. Further, a transport belt may be electrostatically charged with a charge of one type so that an electrostatic pressure is generated and concurrently induces an opposite charge on the ink droplets ejected by the print head, thereby accelerating the droplets toward the recording medium by Coulombic attraction.

This electrostatic field assist improves drop directionality by providing a forward acceleration on the ink drops, thus reducing transit time and minimizing the effect of transverse disturbances. Also, spot placement errors due to variations in ejection velocity between adjacent nozzles are reduced because of the acceleration of the ink drops. Generally, the acceleration of the ink drops from rest rather than drawing on the initial velocity of the drop ejection reduces the power requirement by 40–50%. Accordingly, the combined effect is that more spherical drops are formed, which results in more circular spots and sharper edges on a printed image.

SUMMARY OF THE INVENTION

Field assist relies on inductive charging of the ink drops as they form and the subsequent acceleration of the ink drops in transit through the print gap to the writing medium. Drop charging is a passive process that only requires the ink to be slightly conductive. The charge is imparted when a DC voltage difference is maintained across the print gap. Accordingly, one of the successful implementations of drop charging includes countering the residual drop charge on the printed image because the residual drop charge will cause Coulomb repulsion between incoming ink drops, which leads to image blooming. This undesirable condition leads to a deflection of the drop trajectory away from the printed surface and causes printed images to be wider than they should be and to have less distinct edges.

In light of the above described problems and shortcomings, various exemplary implementations of systems and methods provide for a transfer belt apparatus that includes a grounded print head, a counter-electrode opposite the grounded print head, a first layer provided between the grounded print head and the counter-electrode, a second layer provided over the first layer and between the grounded print head and the counter-electrode, at least two grounded bias transfer rollers, the first layer and the second layer at least partially supported by the at least two grounded bias transfer rollers, and a voltage source that applies a voltage between the grounded print head and the counter-electrode.

Various exemplary implementations provide a method of preventing image blooming in an ink jet printing apparatus having a grounded print head, a counter-electrode opposite the grounded print head, and a bi-layer transfer belt provided between the print head and the counter-electrode that is at least partly supported by two or more transfer bias rollers. The method may include applying a voltage between the print head and the counter-electrode to accelerate ink drops coming out of the print head toward the transfer belt, and evacuating the charge accumulated on the transfer belt with a time constant smaller than a drop ejection frequency of the print head.

Various exemplary implementations provide an image blooming prevention system that includes a controller, a grounded print head functionally coupled to the controller, a counter-electrode opposite the grounded print head, the controller arranged to apply a voltage between the grounded print head and the counter-electrode to accelerate ink drops coming out of the print head, and a first layer and a second layer provided between the grounded print head and the counter-electrode, wherein the resistivity of the first layer is such that a charge accumulated on the first layer is evacuated with a time constant smaller than a drop ejection frequency of the grounded print head.

BRIEF DESCRIPTION OF THE DRAWINGS

Various exemplary implementations are described in detail, with reference to the following figures, wherein.

DETAILED DESCRIPTION

Various features and advantages of this invention are described in, or are apparent from, the following detailed description.

Figure 1:
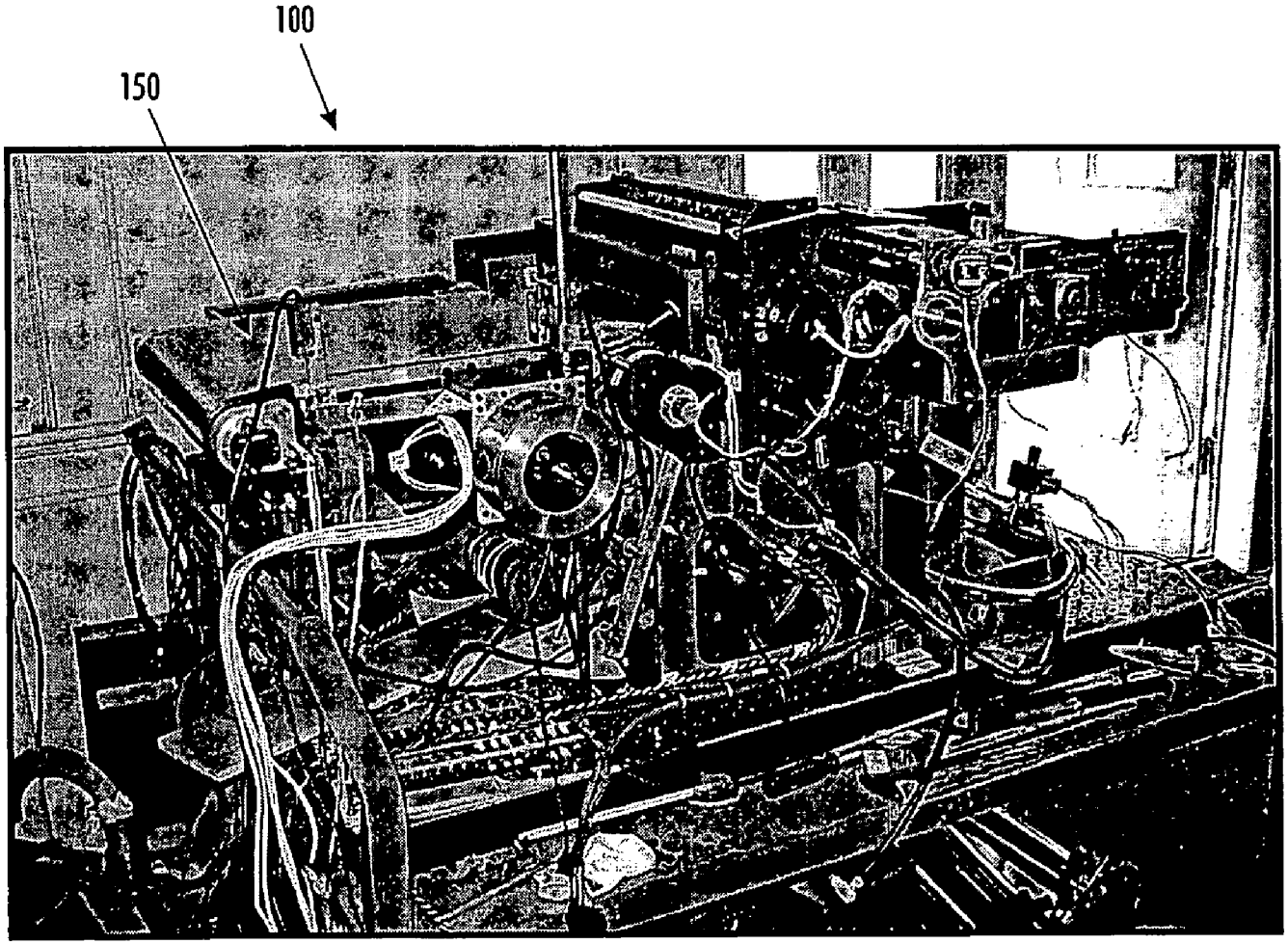
FIG. 1 is a photograph of an exemplary intermediate belt transfused fixture.

FIG. 1 is a photograph of an exemplary intermediate belt transfuse fixture. In FIG. 1, an intermediate belt 150 is shown on which an image is developed followed by a final transfer/transfuse to paper. According to various exemplary implementations, transfuse has the advantage of allowing a wide media latitude and the use of different types of media such as, for example, a large variety of types of paper. In a high speed implementation for phase change acoustic ink printing (AIP), for example, images are printed onto the intermediate belt 150 before transfer/transfuse to paper. The electrical characteristics of the intermediate belt 150 may be designed to support both electrostatic field assist without image blooming, as well as image transfer with minimum smearing. Table 1 shows exemplary dimensions and electric design parameters of the intermediate belt 150.

TABLE 1

Dimensions and Electrical Design Parameters of the Intermediate Belt

| Dimensions & Electrical Parameters | Design Values |
|---|---|
| Belt thickness ($h_1$) - under layer (Gunze-polyamide) | 3 mils |
| Belt thickness ($h_2$) - compliant upper layer (cond. silicone) | 10 mils |
| Belt width (w) | 12 inches |
| Effective print length ($l_h$) | 10 cm |
| Counter Electrode-to-Grounded BTR distance ($l_s$) | 1 cm |
| Air gap (g) | 0.5 mm |
| Belt dielectric constant ($\epsilon_{belt}$) | 3 |
| Belt under layer surface resistivity ($\rho_{s1}$) | 1.14 e$10^{10}$ Ω/cm |
| Belt compliant layer surface resistivity ($\rho_{s2}$) | $10^{14}$ Ω/cm |
| Max. steady-state current | 4.21 uA |
| Steady-state power dissipation | 2.77 mW |
| Upper layer surface voltage ($V_g$) | 1000 V |
| Under layer surface voltage ($V_b$) | 855.23 V |
| Time constant (τ) | 0.025 ms |

Figure 2:
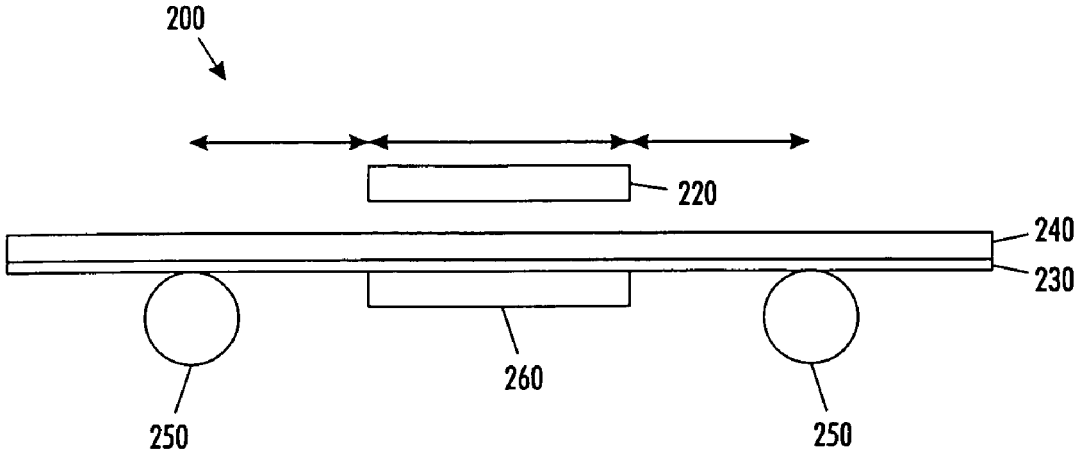
FIG. 2 is a schematic illustration of the cross-section of an exemplary resistive belt arrangement.

FIG. 2 is a schematic illustration of the cross section of an exemplary resistive belt arrangement. In FIG. 2, a print head assembly 200 includes a print head 220 which is electrically grounded and which generates ink drops used for printing. The ink drops generated by the print head 220 may be accelerated, for example, by a high electric field generated between the print head 220 and a counter-electrode 260. The electric field generated between the print head 220 and the counter-electrode 260 may be, for example, about 1000 V. The ink drops generated by the print head 220 may be accelerated towards a composite bi-layer constituted by a first layer 230 and a second layer 240. The first layer may comprise, for example, a 3 mm polyamide substrate, and the second layer may comprise, for example, a 10 mm overlay of conductive compliant silicon rubber. A compliant silicon rubber layer, for example, can conform to the shape dictated by an applied pressure.

Two grounded conducting bias transfer rollers (BTR) 250 may be used to support the composite bi-layer formed by the first layer 230 and the second layer 240, and to isolate the high voltage area in the print zone from the rest of the apparatus. The electrical conductivities of the first layer 230 and the second layer 240 may be chosen in order to prevent image blooming. For example, preventing image blooming may be achieved by leaking off (i.e., evacuating) the charge accumulated on the composite bi-layer belt, formed by the first layer 230 and the second layer 240, with a evacuation time constant of 25 microseconds, which is less than the time between successive drop ejections by print head 220. Alternatively stated, the charge evacuation frequency of the composite bi-layer belt is greater than the drop ejection frequency of print head 220. Accordingly, image blooming may thus be prevented.

Figure 3:
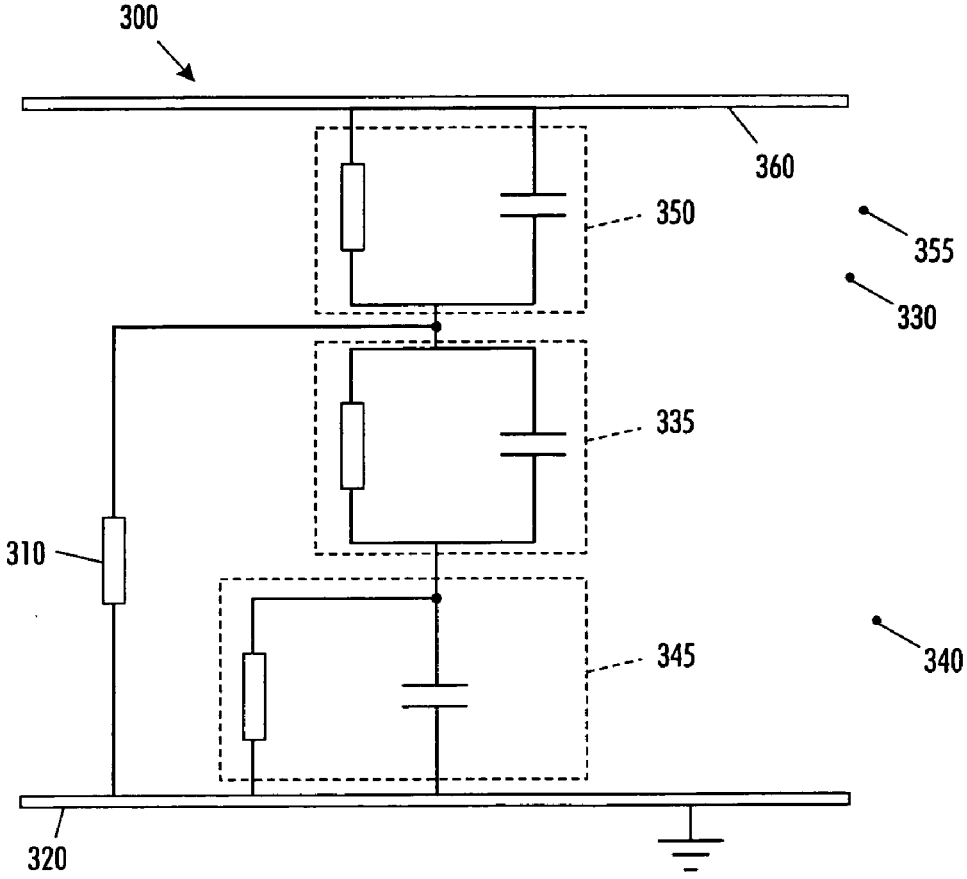
FIG. 3 is a schematic illustration of an exemplary equivalent circuit for a resistive belt arrangement.

FIG. 3 is a schematic illustration of an exemplary equivalent circuit for a resistive belt arrangement. In FIG. 3, equivalent circuit 300 includes a counter-electrode 360 in contact with circuit 350 which represents the impedance path between the counter-electrode 360 and a first layer 330. Circuit 350 may be connected to both circuits 335 and 310, wherein circuit 335 represents the impedance path of the second layer 340, and circuit 310 represents the resistive path between the counter-electrode 360 and the bias transfer rollers 355. Also, circuit 335 may be connected to circuit 345, which represents the resistive path in the air gap between the second layer 340 and the grounded print head 320. Finally, both circuits 345 and 310 may be electrically connected to the grounded print head 320.

Figure 4:
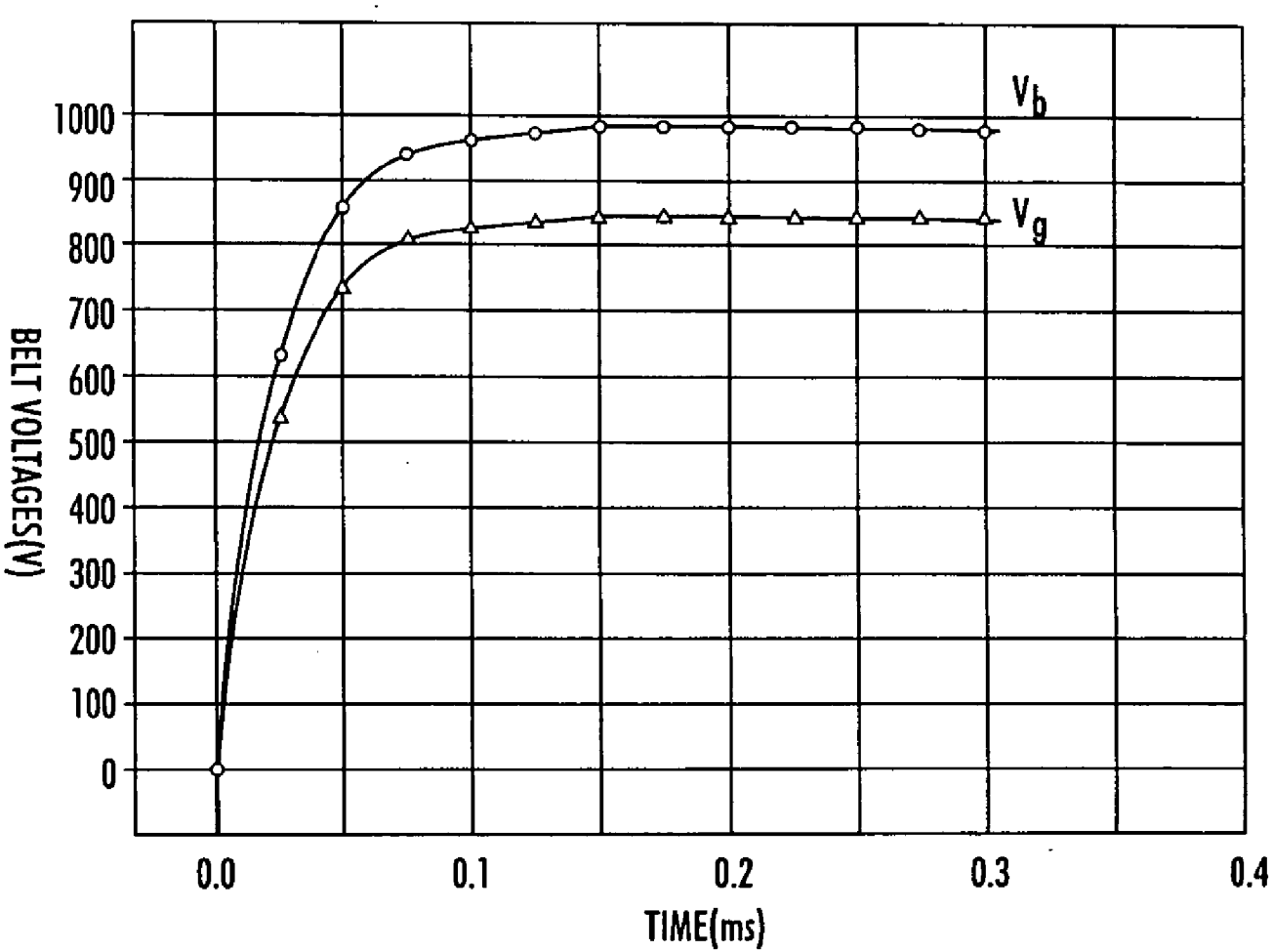
FIG. 4 is a diagram illustrating an exemplary transient response of belt voltages.

FIG. 4 is a diagram illustrating an exemplary transient response of belt voltages. In FIG. 4, the transient response of the belt, when a field assist voltage of about 1000 V is switched on, is illustrated. The two curves $V_b$ and $V_g$, which correspond to an inter-layer voltage $V_b$ and a surface voltage $V_g$, respectively, wherein the inter-layer voltage $V_b$ is the voltage between the first layer and the second layer, and the second voltage $V_g$ is the voltage at the top surface of the second layer, are a measure of the transient response of the belt with respect to time. The rise time indicates the delay in changing to a new voltage. Therefore, to avoid image blooming, the time between successive drop ejections must be smaller than this time delay.

Figure 5:
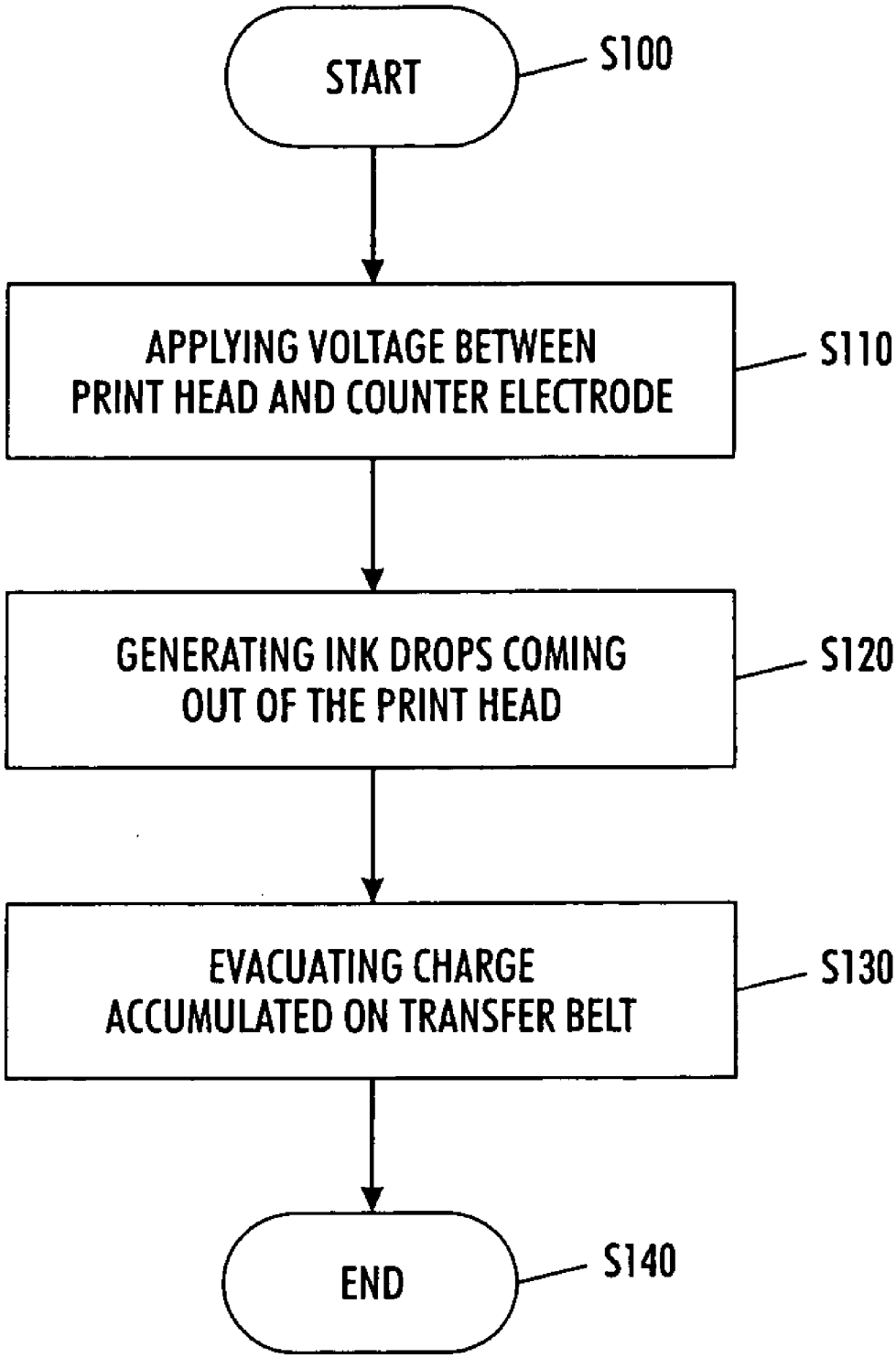
FIG. 5 is a flowchart illustrating a method of preventing image blooming.

FIG. 5 is a flowchart illustrating an exemplary method of preventing image blooming. The method starts at step S100, and continues to step S110, where a voltage is applied between the grounded print head and the counter-electrode. The voltage may be, for example, about 1000 V and may be used to accelerate ink drops coming out of the print head toward a bi-layer transfer belt provided between the print head and the counter-electrode. Next, control continues to step S120, during which ink drops are generated by the print head and are ejected out of the print head. The generation of ink drops may take place after or simultaneously with the application of a voltage as described in step S110. Next, when the ink drops generated from the print head are accelerated from the print head toward the bi-layer transfer belt, control continues to step S130, during which any accumulated charge on the bi-layer transfer belt is evacuated, for example, with a time constant that is smaller than the drop ejection frequency of the print head. The counter-electrode may be supported by two or more transfer bias rollers in order to isolate the print head assembly from the rest of the printer. Next, control continues to step S140, where the method ends. It should be noted that for continuous printing, the voltage applied during step S110 is kept on constantly for the entire duration of the printing.

While details of the invention has been described in conjunction with exemplary implementations, these implementations should be viewed as illustrative, not limiting. Various modifications, substitutes, or the like, are possible.

What is claimed is:

1. A transfer belt apparatus, comprising:

a grounded print head;

a counter-electrode opposite the grounded print head;

a first layer provided between the grounded print head and the counter-electrode with a conductivity that is such that an accumulated charge evacuation time is less than a time interval between successive ejections of ink drops;

a second layer provided over the first layer and between the grounded print head and the counter-electrode that is compliant to prevent image smearing during transfer to paper;

at least two grounded bias transfer rollers, the first layer and the second layer at least partially supported by the at least two grounded bias transfer rollers; and a voltage source that applies a voltage between the grounded print head and the counter-electrode.

2. The transfer belt apparatus of claim 1, wherein the first layer comprises polyamide.

3. The transfer belt apparatus of claim 1, wherein the first layer is about 3 mil thick.

4. The transfer belt apparatus of claim 1, wherein the second layer is about 10 mil thick.

5. The transfer belt apparatus of claim 1, wherein the second layer comprises silicone rubber.

6. The transfer belt of apparatus claim 1, wherein the second layer is conductive.

7. The transfer belt of apparatus claim 1, wherein the voltage source applies a voltage of about 1000 V.

8. The transfer belt of apparatus claim 1, wherein the counter-electrode is slightly curved.

9. The transfer belt of apparatus claim 1, wherein the transfer belt has an effective print length of about 10 cm.

10. The transfer belt of apparatus claim 1, wherein a distance between the counter-electrode and the bias transfer rollers is about 1 cm.

11. The transfer belt of apparatus claim 1, wherein the transfer belt has a dielectric constant of about 3.

12. The transfer belt of apparatus claim 1, wherein the first layer has a resistivity of about $1.14\times10^{10}\Omega$-cm.

13. The transfer belt of apparatus claim 1, wherein the second layer has a resistivity of about $10^{14}\Omega$-cm.

14. The transfer belt of apparatus claim 1, wherein a voltage across the first layer is about 850 V when the voltage source applies a voltage.

15. The transfer belt of apparatus claim 1, wherein a voltage between the print head and the second layer is about 1000 V when the voltage source applies a voltage.

16. The transfer belt of apparatus claim 1, wherein the transfer belt has a time constant of about 0.025 ms.

17. A method of preventing image blooming in an ink jet printing apparatus having a grounded print head, a counter-electrode opposite the grounded print head, and a bi-layer transfer belt provided between the print head and the counter-electrode and at least partly supported by two or more bias transfer rollers, the method comprising:

applying a voltage between the print head and the counter-electrode to accelerate ink drops coming out of the print head toward the transfer belt; and evacuating charge accumulated on the transfer belt with a time constant smaller than a drop ejection frequency of the print head.

18. The method of claim 17, wherein the bias transfer rollers isolate the print head from the rest of the apparatus.

19. The method of claim 17, wherein applying a voltage between the grounded print head and the counter-electrode comprises applying about 1000V.

20. An image blooming prevention system, comprising:

a controller;

a grounded print head functionally coupled to the controller;

a counter-electrode opposite the grounded print head, the controller applying a voltage between the grounded print head and the counter-electrode to accelerate ink drops coming out of the print head; and a first layer and a second layer provided between the grounded print head and the counter-electrode, wherein the first layer has a resistivity such that charge accumulated on the first layer is evacuated with a time constant smaller than a drop ejection frequency of the grounded print head.

* * * * *